United States Patent [19]

Hodnett

[11] 4,194,778

[45] Mar. 25, 1980

[54] WOOD SCOOP

[76] Inventor: C. Leroy Hodnett, 2100 Wren Rd., East Ridge, Tenn. 37412

[21] Appl. No.: 5,193

[22] Filed: Jan. 22, 1979

[51] Int. Cl.[2] ..... A47F 13/08

[52] U.S. Cl. ..... 294/9; 294/55

[58] Field of Search ..... 294/9, 55, 49; D7/104; 15/257.3; 16/110 R; 53/390; 141/108, 109, 319, 331, 334, 391; 209/418

[56] References Cited

U.S. PATENT DOCUMENTS

| | | | |
|---|---|---|---|
| 1,182,412 | 5/1916 | Olesberg | 141/108 |
| 4,126,346 | 11/1978 | Burns | 294/55 |

*Primary Examiner*—James B. Marbert

*Attorney, Agent, or Firm*—Lamont Johnston

[57] ABSTRACT

A wood scoop comprised of a body portion having an open rear and open front end. The bottom body portion consists of a bottom section which is a segment of a section of a cylinder and parallel side walls extending upwardly from the bottom section. A rear handle is fixedly attached to the side walls across the open rear end. A center handle is fixedly attached to the side walls across the top of the body portion at a first point which is located at least about one-half the length of the body from the front end. Two legs are each fixedly attached to each side wall at a second point which is located at least about one-half the length of the body from the front end. Each leg extends to about level with the bottom section. The scoop permits the efficient and hazard free loading of a wood burner with wood logs.

10 Claims, 1 Drawing Figure

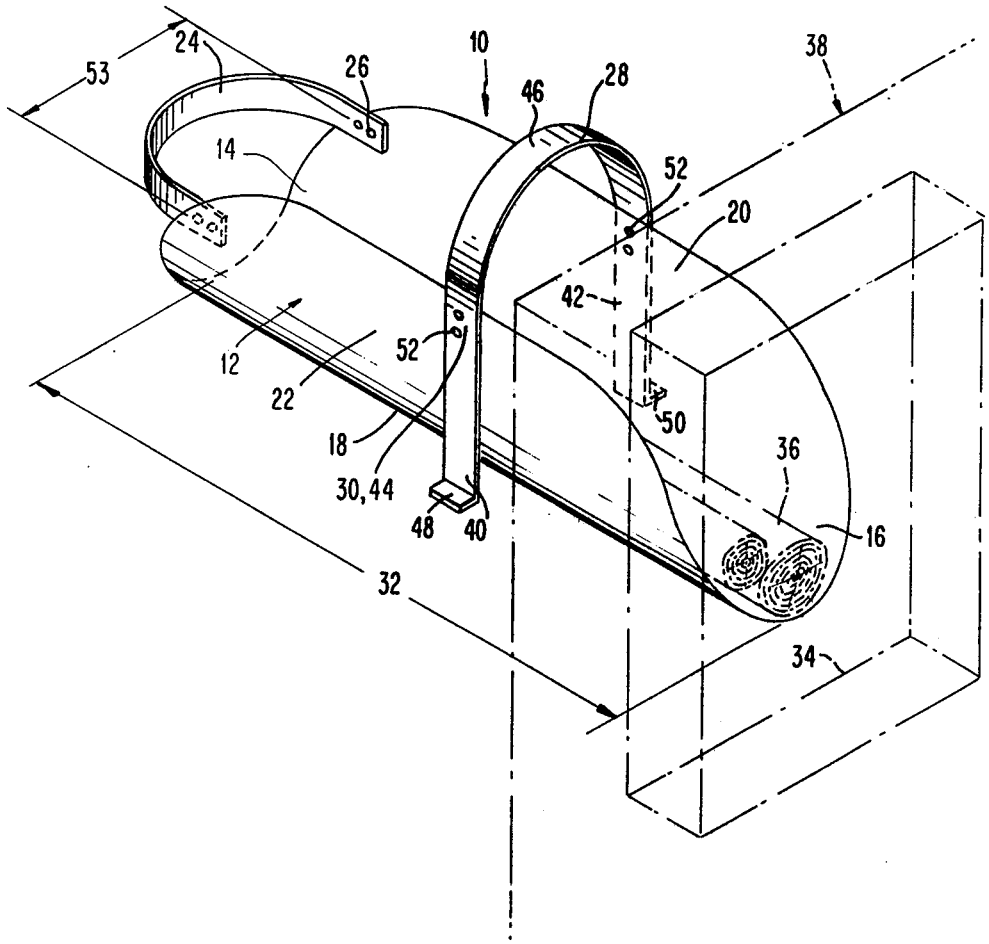
53
24
26
10
46
28
38
14
52
20
42
12
52
22
18
50
36
30,44
48
40
16
32
34

WOOD SCOOP

BACKGROUND

1. Field of the Invention

This invention relates to scoops, and in particular to a wood scoop for loading sections of wood logs into a wood burning stove.

During the past several years, due to the "energy crisis" there have been proposed numerous alternative means for heating houses, and other type buildings and rooms. One proposal is to return to the wood burning stove. The resurgence of the wood burning stove has reached such a level that the government is actively promoting the use of wood burning stoves through its agencies and psuedo-agencies, see for example, "TVA Encourages Use of Wood Stoves", The Chattanooga Times, Nov. 11, 1978, Page A-8.

It has become clear to those now utilizing such stoves, accustomed as they are to the modern conveniences of life, that a more efficient and hazard free method of loading the stove is required than that used now, i.e., picking up a log by hand and throwing it into the stove. Such hand loading causes burns, slow loading, and inconvenience. For example, a typical wood burning stove has a door which is about 10 inches wide and 13 inches high, with perhaps a 3 inch pivoted flap at the top to hold smoke in the stove. To load the stove, one must open the door with one hand and throw or place the log in with the other hand. Loading is slow, smoke gets into the room and burns can occur.

2. Prior Art

An object of this invention is to provide a wood scoop for loading a wood burning stove in an efficient and hazard free manner.

Many different types of scoops are known, see for example the following U.S. Pat. Nos.:

163,752 to Driscole;
247,449 to Webster et al;
256,150 to Mattoon;
304,362 to Seavey;
528,072 to Bukenhofer et al;
741,195 to Voelker;
1,056,572 to Nadeau; and
1,574,837 to Maserang.

There are several disadvantages with these known scoops, in particular, none of the scoops is adapted for the safe and efficient loading of wood logs into a wood burning stove. The foregoing references only describe scoops for coal, grain, sugar, or fluids. Such scoops cannot be used in an efficient and hazard free manner for loading wood logs into a wood burning stove.

SUMMARY OF THE INVENTION

An object of this invention is to provide a wood scoop which can, in an efficient and hazard free manner, be used to load wood logs into a wood burning stove.

Another object of this invention is to provide a scoop which is simple in construction and economical to manufacture.

The wood scoop of this invention is comprised of:

(a) a body portion having an open rear end and open front end, a bottom section which is a segment of a section of a cylinder and parallel side walls extending upwardly from the bottom section;

(b) a rear handle fixedly attached to the side walls across the open rear end;

(c) a center handle fixedly attached to the side walls across the top of the body portion at a first point which is located at least about one-half the length of the body from the front end; and (d) two legs each fixedly attached to each side wall at a second point which is located at least about one-half the length of the body from the front end, each leg extending to about level with the bottom section.

Other objects and advantages will be hereinafter made clearly apparent, reference being made to the specification and accompanying drawing which are made a part of this application.

BRIEF DESCRIPTION OF THE DRAWING

FIG. 1 (the only FIGURE herein) is a perspective view of an embodiment of the wood scoop of this invention.

DETAILED DESCRIPTION OF THE INVENTION

The wood scoop of this invention is utilized to safely and efficiently load wood logs (36) into a wood burning stove (38). The logs (36), are generally, long cylindrical members of, say, about two feet in length.

The wood scoop, generally designated as (10), is comprised of a body portion (12). The body portion (12) has an open rear end (14) and an open front end (16). A curved bottom section (18) is provided. The bottom section (18) is generally a segment of a section of a cylinder, or a shape which substantially conforms thereto. Parallel side walls (20 & 22) are provided which extend upwardly from the bottom section (18).

Preferably the bottom section (18) and the side walls (20 & 22) are integrally formed, for example, out of a sheet metal or plastic stock. Preferably the body portion (12), consisting of the bottom section (18) and parallel side walls (20 & 22), is in a shape which is substantially about 180° segment of a section of a cylinder, or a shape which substantially conforms thereto.

Such a shape to the body portion (12) allows for the parallel stacking of a plurality of wood logs (36) when they are placed in the scoop (10), and allows for the maximum volume utilization when compared to any other type configuration for a body portion (12).

A rear handle (24) is fixedly attached to the side walls (20 & 22) across the open rear end (14). The rear handle (24), when so attached, prevents the wood logs (36) from falling out of the open rear end (14) of the body portion (12), and simultaneously provides a safe and convenient place for the person utilizing the scoop (10) to grasp.

Preferably the rear handle (24) is an integrally formed piece of stock, for example, sheet metal or plastic stock, and is in a shape which is substantially about a 180° segment of a section of a cylinder, or a shape which substantially conforms thereto.

The rear handle (24) is fixedly attached to the side walls (20 & 22) by, for example, two rivets (26) which passes through each end of the rear handle (24) and the side walls (20 & 22). This invention, however, contemplates any means for fixedly attaching the rear handle (24).

By the use herein of the term "fixedly attached" it is meant that the rear handle (24) and center handle (28) discussed below, does not pivot about the point of attachment, thereby allowing one to firmly grasp and control the scoop (10).

A center handle (28) is fixedly attached to the side walls (20 & 22) across the top of the body portion (12) at a first point (30). The center handle (28) is preferably an integrally formed piece of stock, and preferably in a shape which is substantially about a 180° segment of a section of a cylinder, or a shape which substantially conforms thereto. The center handle (28) is preferably constructed of sheet metal or plastic stock.

The first point (30) is located at least about one-half the length of the body portion (32) from the front end (16). The location of the first point (30) is a critical element in the safe and efficient use of the scoop (10). The first point (30), when located as indicated is in close proximity to the center of gravity of the scoop (10), assuming the scoop is made of a homogeneous material. Generally, however, the center of gravity is somewhat further back, due to the weight of the rear handle (24). Thus when one lifts the scoop (10) it is at the center of gravity, or somewhat close thereto, providing easy and well balanced lifting and a sufficient length at the front of the scoop (10), for insertion of the front end (16) into the opening (34) in the wood burning stove (38), but no further than the center handle (28). Thus one can rest the scoop (10) in the opening (34) of the wood burning stove (38) and use the other hand, which was grasping the center handle (28), to push the wood logs (36) into the stove (38) through the opening (34). Preferably, the first point is no further back then about three-fourths the length of the body portion (32) from the front end (16).

The scoop (10) is further comprised of two legs (40 & 42). Each of these legs (40 & 42) is attached to a side wall (20 & 22) at a second point (44). The second point (44) is also located about one-half the length of the body portion (32) from the front end (16). Preferably the first point (30) and the second point (44) are the same. When these points (30 & 44) are the same this insures that the scoop (10) does not go any further into the opening (34) than these points, and one does not have to "chase" the scoop (10) into the stove (38) causing a hazardous condition.

If the second point (44) is forward of the first point (30) this allows the scoop (10) to rest upon the opening (34) at the second point (44) and allows for the tilting of the scoop (10) until the top of the center handle (46) touches the stove (38). Thus one can rest the scoop (10) in the opening (34) and gently push the logs (36) into the stove (38).

Preferably the center handle (28) and legs (40 & 42) are integrally formed, of for example a sheet metal or plastic stock.

Preferably the bottoms of the legs (40 & 42) are turned out into flanges (48 & 50) which rest upon a surface when the scoop (10) is not in use.

In the embodiment depicted in FIG. 1, the center handle (28) and legs (40 & 42) are fixedly attached to the side walls (20 & 22) by two rivets (52).

For general guidance, the diameter (53) of the body portion (12) is about 9 inches and the length of the body portion (32) is about 24 inches. However this invention contemplates any practical dimensions for the wood scoop (10).

The general method for loading a wood burning stove with wood, prior to this invention, was to insert the wood into the opening by hand and hold the wood in the fire box. Loading by this method increases the probability of getting burned by not only the fire, but by touching the hot metal stove surface surrounding the hand.

With the wood scoop of this invention one loads the scoop with wood logs placed parallel to each other, rests the scoop in the opening of the stove and with one hand on the rear handle and the other free gently pushes the wood into the stove. The hands do not come in contact or close proximity with the hot stove nor are they inserted into the stove itself.

The scoop of this invention, in its preferred embodiment, is constructed of only three pieces of rolled sheet metal or plastic stock.

Although the invention has been described and illustrated in detail, such is not to be taken as restrictive thereof, but is intended to include all modifications that would appear to one skilled in the art to be within the spirit of the invention.

What is claimed:

1. A wood scoop comprising:
   (a) a bottom portion having an open rear end an open front end, a bottom section which is a segment of a section of a cylinder and parallel side walls extending upwardly from the bottom section;
   (b) a rear handle fixedly attached to the side walls across the open rear end;
   (c) a center handle fixedly attached to the side walls across the top of the body portion at a first point which is located at least about one-half the length of the body from the front end; and
   (d) two legs each fixedly attached to a side wall at a second point which is located about one-half the length of the body from the front end, the legs extending to about level with the bottom section.

2. The wood scoop of claim 1, wherein the first point and the second point are the same.

3. The wood scoop of claim 2, wherein the center handle and legs are integrally formed.

4. The wood scoop of claim 1, wherein the bottom section and side walls are an integrally formed 180° segment of a section of a cylinder.

5. The wood scoop of claim 3, wherein the bottom section and the side walls are an integrally formed 180° segment of a section of a cylinder.

6. The wood scoop of claim 5, wherein the center handle is a 180° segment of a section of a cylinder.

7. The wood scoop of claim 1, wherein the rear handle is a 180° segment of a section of a cylinder.

8. The wood scoop of claim 6, wherein the rear handle is a 180° segment of a section of a cylinder.

9. The wood scoop of claim 8, wherein the diameter of the circles are about 9 inches.

10. The wood scoop of claim 9, wherein the body portion is about 24 inches in length.

* * * * *